US005271536A

United States Patent [19]

Wilson

[11] Patent Number: 5,271,536

[45] Date of Patent: Dec. 21, 1993

[54] FLEXIBLE HOLDER FOR "LIVING" HINGE JOINING LID TO CLOSURE BODY OF DISPENSING CLOSURE

[75] Inventor: Steven B. Wilson, N. Scituate, R.I.

[73] Assignee: Polytop Corporation, Slatersville, R.I.

[21] Appl. No.: 832,448

[22] Filed: Feb. 7, 1992

[51] Int. Cl.[5] ..... B65D 5/72

[52] U.S. Cl. ..... 222/498; 222/517; 222/556

[58] Field of Search ..... 222/498, 517, 546, 556; 215/235, 238; 220/254, 259, 335, 338, 339, 341

[56] References Cited

U.S. PATENT DOCUMENTS 4,158,902 6/1979 Chernack et al. .
4,220,248 2/1980 Wilson et al. .
4,377,247 3/1983 Hazard et al. .
4,625,898 12/1986 Hazard .
5,065,911 11/1991 Rohr et al. ..... 222/556 X
5,065,912 11/1991 Rosenthal ..... 222/517

*Primary Examiner*—Gregory L. Huson
*Attorney, Agent, or Firm*—Hoffman, Wasson & Gitler

[57] ABSTRACT

A plastic dispensing closure including a closure body, a lid, a resilient "living" hinge joining the lid to the closure body, and camming members defined between the lid and the closure body to temporarily deform the hinge, within its elastic limits, as the lid is moved between its opened and closed position. One end of the hinge is secured to a flexible holder situated at the rear of the closure. Such holder functions as a cantilever beam and serves as a spring to minimize the stress forces imposed upon the "living" hinge. The closure body, lid, and hinge may be integrally molded, and the holder may be situated upon the closure body, or upon the lid, as design considerations dictate.

3 Claims, 5 Drawing Sheets

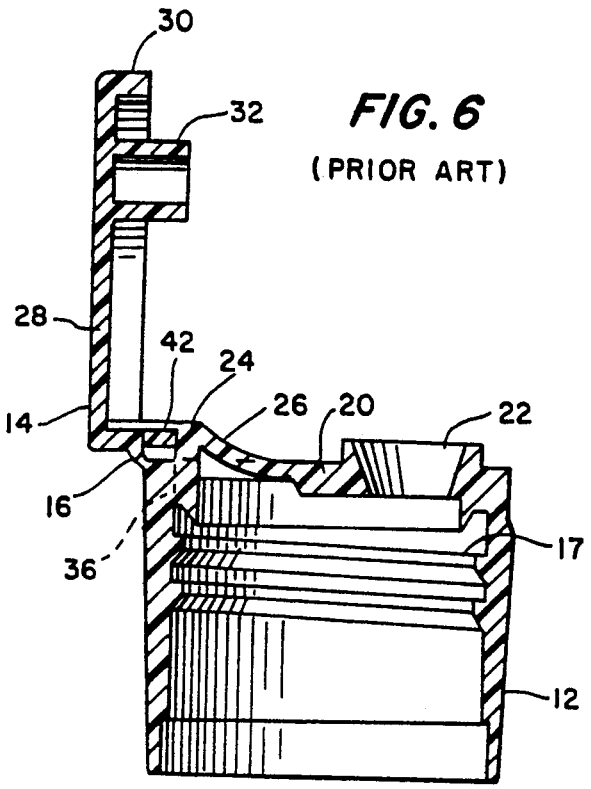
FIG. 6
(PRIOR ART)
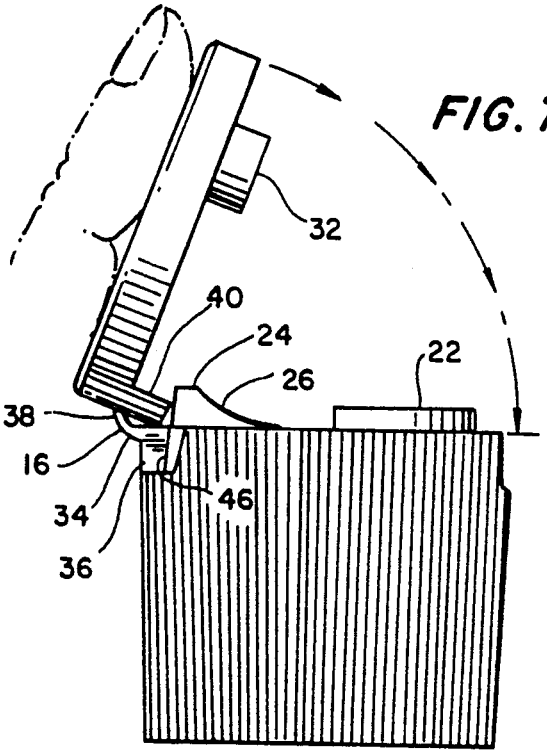
FIG. 7 (PRIOR ART)
FIG. 8
(PRIOR ART)
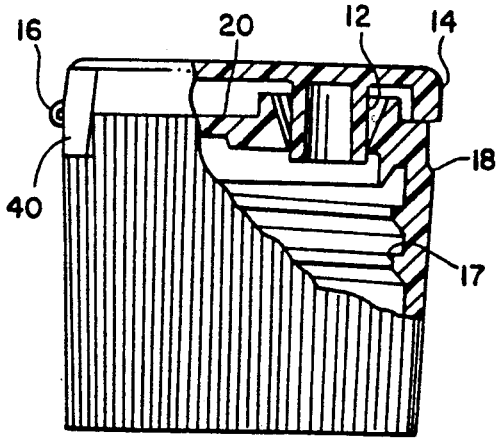

FLEXIBLE HOLDER FOR "LIVING" HINGE JOINING LID TO CLOSURE BODY OF DISPENSING CLOSURE

FIELD OF THE INVENTION

The invention relates generally to dispensing closures having lids that are joined to the closure body by a resilient hinge, such "living" hinge being temporarily deformed by interacting camming surfaces that urge the lid to move between an opened, and a closed, position. More particularly, the invention pertains to a flexible holder for the "living" hinge of a dispensing closure; such holder facilitates the movement of the lid between its two stable states, i.e. opened and closed.

BACKGROUND OF THE INVENTION

Molded plastic dispensing closures, that can be molded at high production rates and with close tolerances, have met with widespread commercial acceptance for dispensing products too numerous to categorize or list. Known dispensing closures usually include (1) a closure body that is secured to the neck of the container holding the product to be dispensed or discharged, (2) a lid that can be pivoted between an open, or discharging position, and a closed position, and (3) a resilient formed hinge joining the lid to the closure body. Such resilient, or "living" hinge may be integrally molded with the lid and closure body, and such "living" hinge enables the lid to be pivoted relative to the closure for the life expectancy of the closure. It should be noted that the "living" hinges are but a few thousandths of an inch in thickness, and are subjected to significant stressing and/or operating forces.

In order to properly stress the "living" hinge as the lid is pivoted between its opened and closed positions, diverse camming mechanisms have been utilized. For example, as shown in U.S. Pat. No. 4,220,248, granted Sep. 2, 1980, to Woodrow S. Wilson and Robert E. Hazard, upstanding resilient posts (50) project upwardly from an upper surface (28) of the closure body and coact with cams, or camming surfaces (52) defined at the lower edge of the skirt (44) of the lid (14). The cams contact, and deform, the resilient posts during movement of the lid, and enhance the successful operation of "living" hinge (16) by temporarily deforming same, within its elastic limits, as the lid is urged between its opened, and closed, position.

A similar camming action is achieved by cooperating, dissimilarly oriented posts or tabs situated on the top surface of the closure body and the underside of the lid, as shown in U.S Pat. No. 4,158,902, granted in June 1979 to Milton Chernack et al.

Another dispensing closure of particular interest is shown in U.S. Pat. No. 4,377,247, granted Mar. 22, 1983 to Robert E. Hazard and Woodrow S. Wilson. The dispensing closure depicted in the Hazard et al patent provides a camming action by virtue of the engagement of the lower edges (52) on the skirt (40) of the lid (14) engaging the upwardly extending, flat wall (22) formed on the upper surface of the closure body, in the vicinity of the "living" hinge (16). The closure body is sealed by a sloping top (18) that includes the flat wall, and a holder (32) is formed to locate the "living" hinge so that the hinge and closure body are joined together.

Further improvements in the camming action defined between the lid and the closure body of a dispensing closure, to temporarily deform the "living" hinge joining the lid to the closure body, are shown in U.S. Pat. No. 4,625,898, granted Dec. 2, 1986, to Robert E. Hazard. Such patent discloses two embodiments of integrally molded, unitary, plastic dispensing closures comprising a body, a lid, and a "living" hinge that joins the lid to the body. In the preferred embodiment of FIGS. 11-18, recesses (436, 438) are formed at the rear of the closure body (402) to accommodate the cams, or lugs (432, 434) when the lid (404) is in its closed position. In the alternative embodiment of FIGS. 19-24, recesses (544; 546) are formed in the skirt of the lid to accept upwardly extending posts (522, 524), and a cavity (518) is defined in the upper surface of the closure body to accept cams, or lugs (534, 536), depending below the lid.

In order to insure that the "living" hinge is properly stressed, and is capable of stretching sufficiently to empower the snap-acting movement of the lid between its opened and closed positions, dispensing closures are usually molded in the opened position. After molding, lids are snapped shut while the plastic remains at an elevated temperature. However, the camming members defined between the lid and the upper surfaces of the body tend to collapse when the lid is closed, and/or the camming members may dig into, or penetrate, the cooperating surfaces used to stress same. Also, in some instances, the "living" hinge may stretch excessively. All of these problems contribute to a higher than desirable rate of closure rejects, which, in turn, adversely impacts upon the manufacturing costs for such dispensing closures. Even a fraction of a penny difference in manufacturing costs, per closure, can have a major impact in the highly competitive, cost-conscious, marketplace.

While molded plastic dispensing closures described above, as well as other dispensing closures, have met with widespread commercial acceptance, because of satisfactory operation, relatively low cost, and aesthetic appeal for mass marketed products such as hair care products and foodstuffs, several operational shortcomings have been encountered, which remain unaddressed. These shortcomings center about the "living" hinge, and the camming mechanisms for deforming, or stretching such hinge, within its elastic limits.

Known molded plastic dispensing closures, as exemplified by the patented structures discussed above, are configured so that all, or at least almost all, of the pivoting movement of the lid between its opened and closed positions is attributable to the temporary, plastic deformation, or stretching, of the "living" hinge. To counteract the harmful effects of the repeated stretching of the "living" hinge, such hinges are made thicker than otherwise necessary. Also, the camming mechanisms defined between the lid and the closure, of necessity, require significant interference between the interacting components to deform the "living" hinge, even momentarily. Such interference between the interacting components requires very close molding tolerances, and causes a high incidence of hinge breakage.

In some instances, the "living" hinge is deformed beyond its elastic limit, and the hinge loses its resiliency, leading to customer complaints. Additionally, at low temperatures, the "living" hinge becomes embrittled, and performs poorly, thus limiting the potential applications for dispensing closures utilizing such component. At the very least, the repeated deformation of the "living" hinge, particularly in the areas where the hinge has been thickened, causes whitening, or discoloration, of the hinge, thereby reducing the aesthetic appeal of the closure.

One known solution for combatting the deficiencies detailed above calls for an elastomer additive to be introduced into the plastic, prior to molding same, so that the "living" hinge will stretch an extra fraction of an inch before exceeding its plastic limit. The elastomer additive, however, is fairly costly and must be blended with care in the molding process; also, the desired glossy finish of the molded polymeric plastic is more easily scuffed and abraded in the presence of the elastomer additive.

Another known solution for combatting the deficiencies noted above revolves about the addition of a lubricant to the polymeric plastic prior to molding same; the lubricant reduces the tendency of the camming members on the skirt of the lid from penetrating, or indenting, the upstanding member(s), such as posts, walls, tabs, or the like, adjacent the "living" hinge. The lubricant facilitates the sliding action of the camming members, despite the high stresses inherent in the design of such dispensing closures. The addition of the lubricant, however, dulls the surface finish of the molded dispensing closure, increases the cost and complexity of manufacturing the closure, and causes problems with the internal threads in the closure body that secure the closure onto the container for the product to be dispensed.

The elastomer additive, and the lubricant, obviously introduce additional complexities and costs in the molding process, lead to defective closures, and complicate the re-grinding and re-cycling of defective closures. Thus, more feasible solutions to the on-going problems associated with dispensing closures utilizing living hinges, are still sought, and promise significant benefits to the manufacturer, and ultimately, to the consumer.

SUMMARY OF THE INVENTION

Thus, with the deficiencies of conventional dispensing closures utilizing "living" hinges clearly in mind, the instant invention contemplates a unitary dispensing closure that is easy to mold, and provides a more reliable "living" hinge without resorting to elastomeric additives and/or plastic lubricants. Conventional dispensing closures rely upon a rigid, enlarged, plastic holder on the closure body to retain one end of the "living" hinge in fixed position; see, for example, reinforced holder 426 in FIGS. 16 and 17 of U.S. Pat. No. 4,625,898, Hazard, and holder 32 in FIGS. 3 and 4 of U.S. Pat. No. 4,377,247, Hazard et al.

In contrast thereto, the instant invention employs a flexible holder, situated at the rear of the closure body, or upon the lid, to anchor one end of the "living" hinge. Such holder may assume the form of a cantilevered post, which possesses sufficient resiliency to provide most, if not all, of the snap action usually attributable to the temporary deformation of the "living" hinge by the interacting camming mechanisms defined between the lid and the closure body. Since only a minor portion of the snap, or spring, action of the dispensing closure will be attributable to the "living" hinge, the life of the hinge will be significantly extended. The unsightly "whitening" of the hinge will be reduced because there will be no reason to thicken the hinge in the area of repeated stretching.

Also, the flexible holder for the "living" hinge in the instant invention will allow greater tolerances in the molding process without diminishing the effectiveness of the sealing operation for the closure when the plug on the underside of the lid is pressed into an aperture on the upper surface of the closure body. Lateral forces readily harm, or destroy, conventional "living" hinges, or, at the very least, cause serious alignment problems in sealing operations. However, the flexibility of the holder in the present invention insures repeated, effective, alignment of the sealing plug and orifice that seal the container upon which the closure is mounted. The enhanced sealing operations reduce leakage, and/or drippage, of the product to be dispensed, and preclude the accumulation of debris, dirt, etc. on the exposed surfaces of the dispensing closure.

Additionally, the present invention, with its flexible holder for the "living" hinge, provides a dispensing closure that is operable over wider temperature ranges, opening up potential applications that were previously beyond the capability of known dispensing closures of this type. To illustrate, the present invention could be more reliably applied to containers for products stored in freezers customarily used in markets and homes. Also, the instant dispensing closure can readily be molded on existing multiple cavity molds by virtue of minor modifications to existing molds, and with no changes required to the molding machine.

Furthermore, the present invention relies upon a flexible holder that is situated at the rear of known dispensing closures, such holder being formed as a cantilever beam to increase the extent of relative movement between the lid and the closure body and compensate for molding imperfections. The flexible holder serves as an anchor for one end of the living hinge, and performs this function as effectively as the rigid, pillar-like, holders of known dispensing closures.

Additionally, while the flexible holder may be secured to the closure body, and the "living" hinge interconnects the flexible holder and the lid, the flexible holder might be situated on the lid, and the "living" hinge would still function in its usual fashion.

Other advantages and benefits realized by the present invention will become readily apparent to the skilled artisan when the specification is construed in harmony with the appended drawings.

BRIEF DESCRIPTION OF THE DRAWINGS

FIG. 6 is a vertical cross-sectional view of the closure of FIGS. 1-5, such view being taken along the line 6—6 in FIG. 2, and in the direction indicated;

FIG. 7 is a side elevational view of the closure of FIGS. 1-6, such view showing the closure being pivoted from its opened position toward its closed position;

FIG. 8 is a side elevational view, with fragments broken away, showing the conventional closure of FIGS. 1-7 in its closed condition;

DESCRIPTION OF PRIOR ART DISPENSING CLOSURES

FIGS. 1-10 depict a conventional dispensing closure manufactured and sold by Polytop Corporation of Slatersville, R.I., the assignee of the present invention, as well as the assignee of U.S. Pat. Nos. 4,220,248; 4,377,247; and 4,625,898. Such dispensing closures, and similar dispensing closures bearing the trademark POLYCAM, are sold by Polytop Corp. to numerous packers of sundry products, including shampoos, hand lotions, food products, and the like. The conventional dispensing closure depicted in FIGS. 1-10 of the present application corresponds, substantially, to the dispensing closure depicted in FIGS. 11-18 of U.S. Pat. No. 4,625,898.

Figure 1:
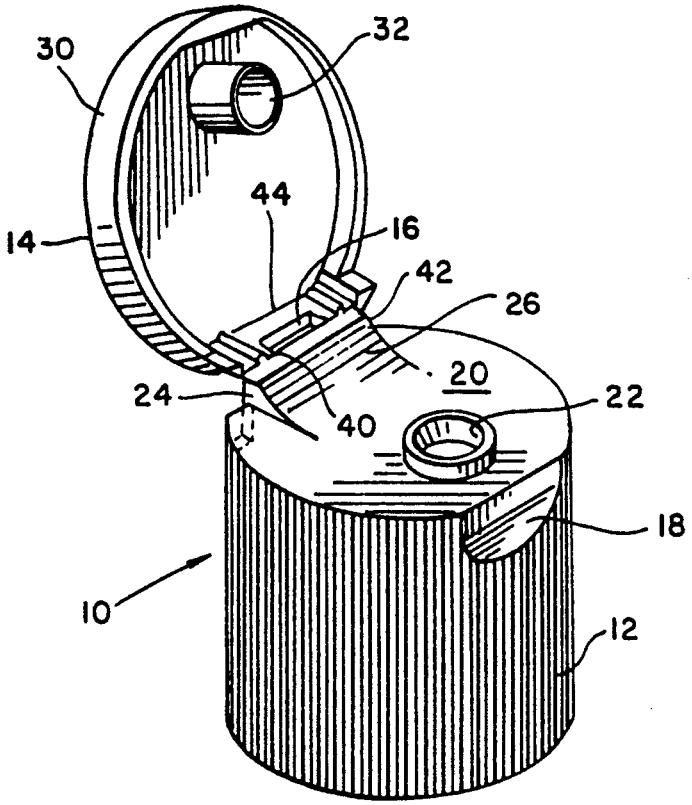
FIG. 1 (PRIOR ART)
FIG. 1 is a perspective view taken from the front of a conventional dispensing closure such as shown in FIG. 11 of U.S. Pat. No. 4,625,898, such closure being shown in its opened position.
Figure 2:
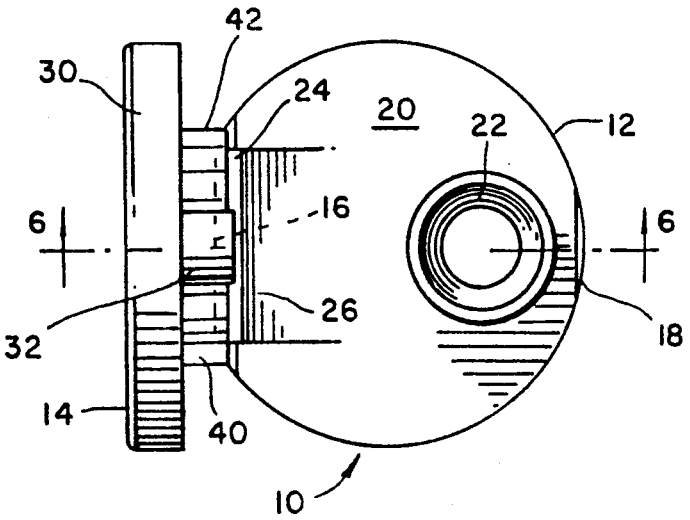
FIG. 2 (PRIOR ART)

Such conventional closure is identified generally by reference numeral 10, and comprises a closure body 12, a lid 14, and a "living" hinge 16 that joins the lid to the body. The body, lid, and hinge are integrally molded of a durable plastic to form a one-piece closure. Closure body 12 is substantially cylindrical in shape, and has internal threads 17 so that the closure body can be secured to the neck of a container (not shown) for the product to be dispensed. An indentation 18 is formed in the front of the closure, and a top surface 20 extends across the upper end of the closure body. A discharge opening 22 extends through surface 20. A thickened wall 24 projects upwardly above surface 20, and a wall 26 slopes downwardly from the top of wall 24 to blend into surface 20, as shown in FIGS. 1 and 2.

Lid 14 comprises a continuous planar top 28 and a shallow annular skirt 30. A sealing plug 32 depends below the skirt. The plug 32 fits into opening 22 to seal the contents of the container to which the closure has been secured when the lid is pivoted toward its closed position, as shown in FIG. 7.

Hinge 16 is but a few thousandths of an inch in thickness, and its length and width are but small fractions of an inch. One end of hinge 16 is joined along a first pivot line 34 to rigid holder 36, which is located diametrically opposite to indentation 18, and extends vertically about half-way up thickened wall 24, as shown in FIG. 6. The other end of hinge 16 is joined to lid 14 along second pivot line 38.

A first lug 40 depends below the shallow skirt 30 of lid 14 at one side of hinge 16, and a second lug 42 depends below the shallow skirt at the opposite side of the hinge. A bridge 44 extends between the lugs and reinforces same. In the opened position shown in FIGS. 1, 2, 6, and 9, the lower surfaces of the lugs 40 and 42 bear against thickened wall 24, and coact therewith.

As shown in FIG. 7, the lugs contact thickened wall 24, and slide therealong, as manual pressure pivots the lid out of its stable, opened position toward its closed position. The interference between the lugs and thickened wall produces a resultant force within the hinge 16 that temporarily deforms, or stretches same, within its elastic limit, so that the lid moves between its two stable states, in a snap-acting or toggle-like fashion. After the lid 14 has moved toward its closed position, lid 14 is manually depressed so that plug 32 fits securely into opening 22 to seal the container (not shown), in the manner shown in FIG. 8.

A first recess 46 is formed at the rear of the closure body 12 adjacent holder 36, and a second recess 48 is formed at the rear of the closure body on the opposite side of holder 36. The recesses have a vertical dimension that is slightly larger than the vertical dimensions of lugs 40, 42, and a radial dimension that is slightly greater than the thickness of lugs 40, 42. The portion of reinforced wall 24 extending below the top surface 20 of the closure defines the innermost extent of the recesses. Thus, when the lid is closed and plug 32 projects into opening 22, as shown in FIG. 8, the lugs fit within the recesses and conform to the substantially cylindrical shape of the closure body 12. Bridge 44 fits over holder 36.

Figure 3:
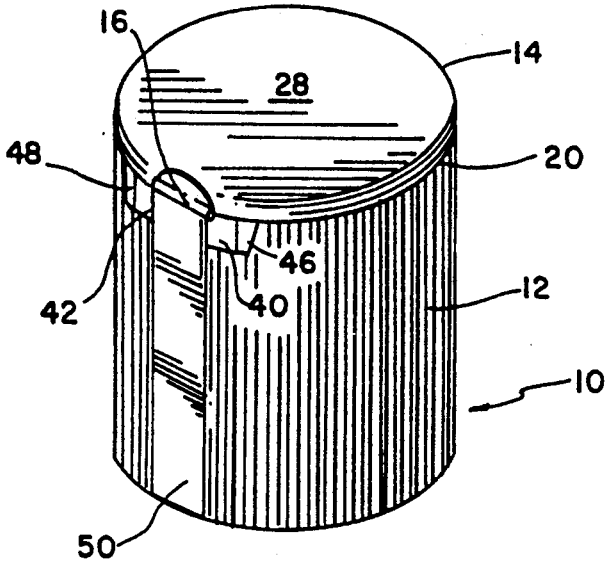
FIG. 3 (PRIOR ART)
FIG. 3 is a perspective view taken from the rear of the closure of FIG. 1, with the closure being shown in its closed position.
Figure 4:
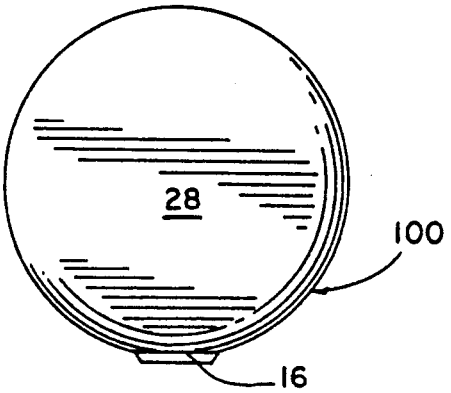
FIG. 4 (PRIOR ART)
FIG. 4 is a top plan view of the closure of FIGS. 1-3, with the closure being shown in its closed position.
Figure 5:
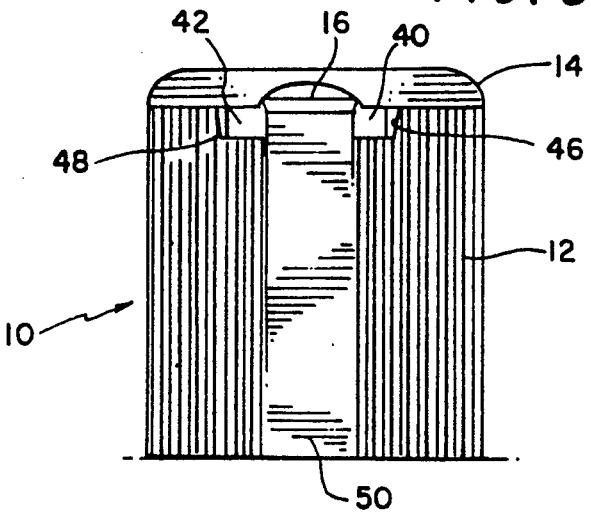
FIG. 5 (PRIOR ART)
FIG. 5 is a rear elevational view of the closure of FIGS. 1-4, with the closure being shown in its closed position.

The cylindrical shape of the closure body is interrupted by a flat 50 on its rear surface. The holder 36 is situated atop flat 50, as shown in FIGS. 3 and 5. While the flat may be advantageous in molding and handling large closures, the flat may be unnecessary with some smaller closures. In both instances, the holder is situated in the same location.

Figure 9:
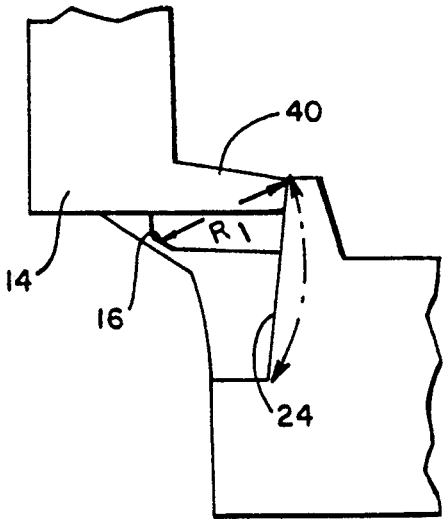
FIG. 9 (PRIOR ART)
FIG. 9 is a fragmentary view, on an enlarged scale, of the lugs on the lid, the cooperating surfaces on the closure body, and the "living" hinge of the conventional closure of FIGS. 1-8, such view showing the lid in its opened position.

FIG. 9 shows the manner in which the lugs 40, 42 depending below the skirt of lid 14 will move into contact with the thickened wall 24 on the body of the known closure shown in FIGS. 1-8. In the opened position of FIG. 9, the flat bottom surfaces of lugs 40, 42 contact the wall, while the hinge 16 is stressed lightly. The distance "R1" is the radial distance from the midpoint of the hinge to the upper corner of the lug, and the dotted line indicates the curved path of radius "R1" that the lug would travel if there were no resistance to the movement of the lid.

Figure 10:
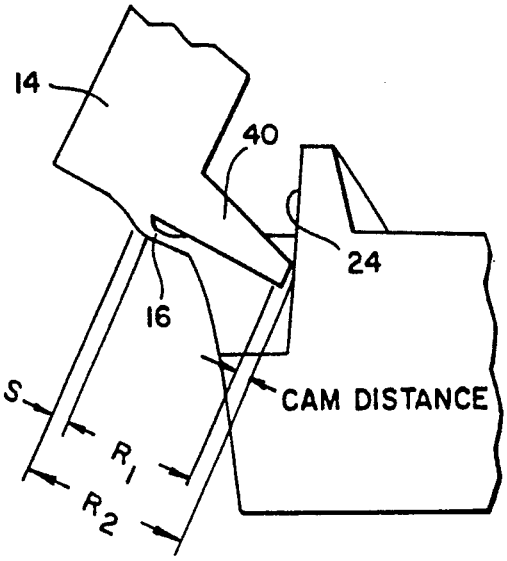
FIG. 10 (PRIOR ART)
FIG. 10 is a view similar to FIG. 9, but showing the lid components as the lid moves toward its closed position.

FIG. 10 shows the manner in which the lugs 40, 42 coact with the thickened wall 24. Because of the interference between the coacting lugs and wall 24, the lugs travel in an arcuate path, having a slightly larger radius, R2. The distance R2 is the radial distance from the midpoint of the hinge to the upper corner of the lug, which is the corner that contacts, and slides along, wall 24. The difference between these two radii is S, and S represents the deformation, or stretching, that must take place within hinge 16 to insure successful operation of the closure as lugs 40, 42 travel along the curved path having radius "R2". Manifestly, the stresses placed upon the thin web of hinge 16 are significant in order to momentarily deform same, within elastic limits. The hinge, consequently, functions as a resilient spring that becomes the focal point for closure failures.

DESCRIPTION OF THE PREFERRED EMBODIMENT

Figure 11:
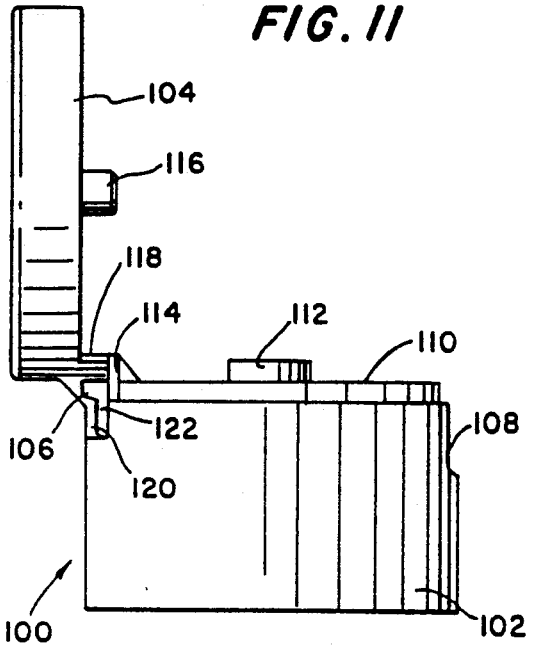
FIG. 11 is a side elevational view of the preferred embodiment of a dispensing closure constructed in accordance with the principles of the present invention, such view showing the flexible holder situated on the closure body.
Figure 12:
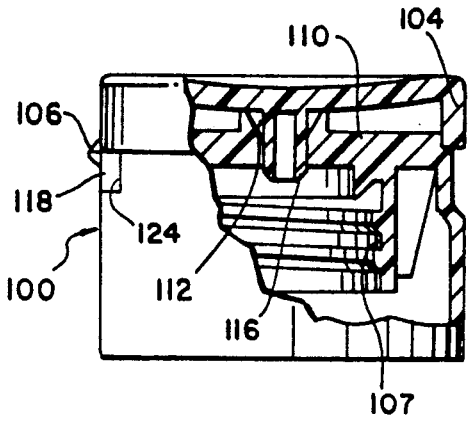
FIG. 12 is a side elevational view, with fragments broken away, of the dispensing closure of FIG. 11 in its closed position.

FIGS. 11 and 12 depict a preferred embodiment of a closure 100 constructed in accordance with the principles of the lid 104, and a "living" hinge 106 that joins the lid to the closure body. The body, lid, and hinge can be integrally molded. Closure body 102 is substantially cylindrical in shape, and has internal threads 107 so that the closure body can be secured to the neck of a container (not shown). An indentation 108 is formed in the front of the closure, and a top surface 110 extends across the upper end of the closure body. A discharge opening 112 extends through surface 110. Wall 114 projects above the top surface 110 in the vicinity of hinge 106.

Lid 104 comprises a planar top and a shallow depending skirt. A plug 116 extends below the skirt, and at least one lug 118 depends below the skirt. Closure 100 is shown in its opened position in FIG. 11, and the bottom surface of lug 118 presses against wall 114.

In contrast to the rigid, and/or reinforced holders used in known dispensing closures, a flexible holder 120 is situated at the rear of closure body 102. A gap 122 spaces the holder a short distance from the rest of the closure body, and allows the holder to flex as a cantilever beam. One end of hinge 106 is joined to the upper end of holder 120, and the other end of hinge 106 is joined to lid 104.

When the lid is closed as shown in FIG. 12, the plug 116 fits snugly into opening 112 in the body of the closure, and the contents of the container are sealed. Lug 118 fits into a recess 124 adjacent the holder 120, so that the aesthetic appearance of the closure is enhanced.

Figure 13:
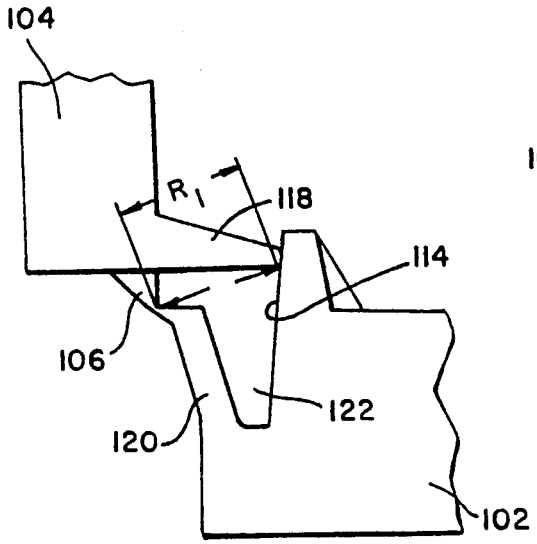
FIG. 13 is a fragmentary view, on an enlarged scale, of the lugs on the lid, the cooperating surfaces on the closure body, and the "living" hinge of the preferred embodiment of the unique closure of FIGS. 11-12.

FIG. 13 shows the lug 118 pressing against unyielding rigid wall 114 when the lid 104 is in its opened position. The wall 114 may taper slightly to prevent binding between the components of the camming mechanism. The radial distance from the fold line in the hinge, at its point of joinder to the upper end of holder 120 to the end of lug 118, is designated as R1. Holder 120 is flexed rearwardly at this moment, thus absorbing most of the stress usually imposed upon the "living" hinge.

Figure 14:
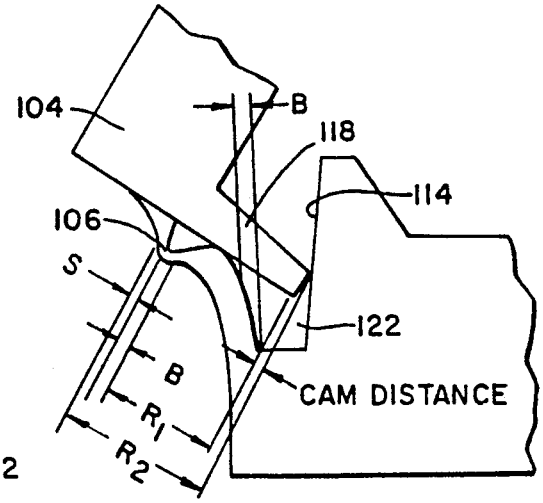
FIG. 14 is a view similar to FIG. 13, but showing the components as the lid moves toward its closed position.

FIG. 14 shows the lug 118 moving downwardly along wall 114 as the lid is pivoted toward its closed position. The lug 118 attempts to travel along a slightly larger radial path R2, but in actuality, because of the interference of wall 114, it travels a straight line until the interference ends. Holder 120, because of its location and configuration, moves a distance "B" away from its normal, slightly stressed position of FIG. 13, thus absorbing the interference by flexing like a spring. Also, "living" hinge 106 is temporarily deformed, within its elastic limit, to add an increment of movement "S", due to the minimal amount of stretching inherent in the unique closure configuration of FIGS. 11–14. The holder is flexible and returns to its usual position shown in FIGS. 11 and 113, when the lid is opened again.

Under optimum design conditions, all, or almost all, of the spring action needed to pivot the lid between its two stable conditions, will be supplied by the holder, and the "living" hinge will remain largely unstressed, yet fully functional, when necessary, during the extended life of the dispensing closure.

ALTERNATIVE EMBODIMENT

Figure 15:
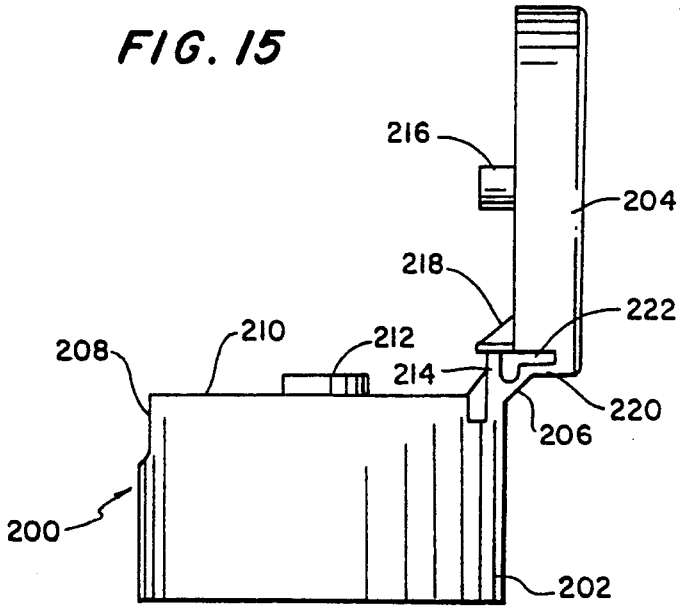
FIG. 15 is a side elevational view, of a first alternative embodiment of a dispensing closure constructed in accordance with the present invention, such view showing the flexible holder situated on the lid.

While the preferred embodiment of FIGS. 11–14 utilizes a flexible holder 120 integrally formed with, or secured to, the closure body 102, the alternative embodiment of FIG. 15 stresses that the flexible holder could be integrally formed with, or secured to, the lid, rather than the closure body. FIG. 15 depicts a closure 200, including a closure body 202, a lid 204, and a "living" hinge 206 that joins the lid to the closure body. The closure body, lid, and hinge, can be integrally molded. An indentation 208 is formed in the front of the closure, so that one can easily open the lid, and a top surface 210 extends across the upper end of the closure body. A discharge opening 212 extends through surface 210. Post 214 projects above the top surface of the closure body in the vicinity of hinge 206.

Lid 204 comprises a planar top and a shallow depending skirt. A plug 216 extends below the skirt. A rigid lug 218 also depends below the skirt of the lid in the vicinity of hinge 206. Closure 200 is shown in its opened position in FIG. 15, and lug 218 rests atop post 214.

A flexible holder 220 is situated at the rear of lid 204 in the vicinity of hinge 206. A gap 222 spaces the holder a short distance from the remainder of the lid, and allows the holder to flex as a cantilever beam. One end of hinge 206 is joined to the free end of holder 220 on lid 204, and the other end of hinge 206 is joined to closure body 202.

Numerous other changes can be made to the configuration of the unique dispensing closure without departing from the principles of applicant's invention as depicted in FIGS. 11–14. For example, wall 114 may be replaced by posts or tabs, and holder 120 may be replaced by an arcuate member that is joined to the "living" hinge along a fold line. Also, since holders 120 and 220 provide most of the spring-action between the lid and the closure body, "living" hinges 106 and 206 may be made thinner than the current norm, without sacrificing the desirable operating characteristics associated with the dispensing closure shown in FIGS. 11–15. The container upon which the closure is seated need not be cylindrical, and the threads on the closure body may be replaced by beads or lugs. The plug which fits within the orifice in the upper surface of the closure body need not project below the skirt of the lid.

Consequently, the appended claims should not be limited to their exact terms, but should be broadly construed in a fashion commensurate with the significant advances in the useful arts and sciences realized by the instant dispensing closure.

I claim:

1. An integrally molded plastic dispensing closure comprising:

a) a closure body adapted to be secured to a container, b) said closure body comprising a skirt and a planar top surface, c) an opening extending through said top surface, d) a lid comprising a planar upper surface and a depending skirt, e) a plug projecting downwardly from said lid, said plug being sized to fit into said opening, f) a thin, resilient hinge extending between said lid and said closure body, g) a holder for said hinge defined between said closure body and said lid, h) one end of said hinge being secured to said holder for facilitating pivotal movement of said lid relative to said closure body, i) camming means defined between the skirt of said lid and said body of said closure body to temporarily deform said hinge, within its elastic limits, as said lid moves between its opened and closed position, j) the invention being characterized in that said holder is configured as a cantilever beam and flexes during engagement of said camming means to minimize the stresses imposed upon said hinge.

2. The dispensing closure of claim 1 further characterized in that a gap separates said holder from the rest of said closure body to facilitate the flexure of said holder.

3. The dispensing closure of claim 1 further characterized in that said holder is situated on the skirt of said lid, and that a gap separates the holder from the rest of said lid.

* * * * *